US008009002B2

(12) United States Patent
Fiedler

(10) Patent No.: US 8,009,002 B2
(45) Date of Patent: Aug. 30, 2011

(54) DETACHABLE MAGNET HOLDER

(76) Inventor: Joachim Fiedler, Berlin (DE)

( * ) Notice: Subject to any disclaimer, the term of this patent is extended or adjusted under 35 U.S.C. 154(b) by 0 days.

(21) Appl. No.: 12/724,027

(22) Filed: Mar. 15, 2010

(65) Prior Publication Data

US 2010/0171578 A1 Jul. 8, 2010

Related U.S. Application Data

(63) Continuation of application No. 10/599,566, filed as application No. PCT/DE2005/000570 on Mar. 30, 2005, now abandoned.

(51) Int. Cl.
*H01F 7/02* (2006.01)
*E05C 17/56* (2006.01)
*E05C 19/16* (2006.01)

(52) U.S. Cl. ..... 335/306; 292/251.5

(58) Field of Classification Search ..... 335/302, 335/306; 292/251.5
See application file for complete search history.

(56) References Cited

U.S. PATENT DOCUMENTS

| | | | | |
|---|---|---|---|---|
| 1,664,476 | A | 3/1928 | Geib | |
| 3,288,511 | A * | 11/1966 | Tavano | 292/251.5 |
| 3,372,443 | A * | 3/1968 | Daddona, Jr. | 24/303 |
| 3,596,958 | A * | 8/1971 | Bowerman | 292/201 |
| 4,099,755 | A * | 7/1978 | Anderson | 292/251.5 |
| 4,265,002 | A * | 5/1981 | Hosken | 24/303 |
| 4,840,411 | A | 6/1989 | Sowersby | |
| 5,367,891 | A * | 11/1994 | Furuyama | 63/29.2 |
| 6,594,871 | B2 * | 7/2003 | Hoffman | 24/303 |
| 6,640,398 | B2 * | 11/2003 | Hoffman | 24/303 |
| 6,707,360 | B2 * | 3/2004 | Underwood et al. | 335/288 |
| 6,929,291 | B2 * | 8/2005 | Chen | 292/251.5 |

FOREIGN PATENT DOCUMENTS

| | | | |
|---|---|---|---|
| BE | 669 664 | | 12/1965 |
| CN | 86102875 | A | 9/1986 |
| CN | 2101320 | U | 4/1992 |
| CN | 1063176 | A | 7/1992 |
| CN | 1216904 | A | 5/1999 |
| CN | 1286951 | A | 3/2001 |
| DE | 97 706 | | 5/1973 |
| DE | 2 323 058 | | 11/1974 |
| DE | 24 55 520 | A1 | 5/1976 |
| DE | 89 02 181.9 | | 2/1989 |
| DE | 89 02 181 | U1 | 5/1989 |
| DE | 296 22 577 | U1 | 6/1997 |
| GB | 2264975 | A | 9/1993 |
| JP | 59-117574 | | 8/1984 |
| JP | 6-000127 | | 6/1992 |

(Continued)

*Primary Examiner* — Elvin G Enad
*Assistant Examiner* — Alexander Talpalatskiy
(74) *Attorney, Agent, or Firm* — Henry M. Feiereisen; Ursula B. Day

(57) ABSTRACT

The invention relates to a universally applicable detachable magnet holder with a fixed magnet and an opposite-lying magnet which can rotate about a point of rotation and which is provided with magnet pole surfaces, wherein each magnet pole surface comprises at least two poles which, when closed, attract each other and which, when open, repel each other once the rotatable magnet has been rotated by means of an actuation device. According to the invention, a distance element (7), made of a non-ferromagnetic material, is fixed to one of the magnet pole surfaces, whereby the bearing surface on the opposite magnet pole surface is a maximum ⅓ of the surface and a centering engaging device (10*a*, 10*b*; 11) is arranged in the vicinity of the magnet poles in order to receive magnetic sheer forces.

10 Claims, 2 Drawing Sheets

FOREIGN PATENT DOCUMENTS

| | | | |
|---|---|---|---|
| JP | 10165208 | A | 6/1998 |
| JP | 11107608 | A | 4/1999 |
| JP | 2000325116 | A | 11/2000 |
| JP | 3081242 | | 8/2001 |
| JP | 2002210912 | A | 8/2002 |
| WO | WO 03/005847 | A1 | 1/2003 |

* cited by examiner

DETACHABLE MAGNET HOLDER

CROSS-REFERENCES TO RELATED APPLICATIONS

This application is a continuation of prior filed copending U.S. application Ser. No. 10/599,566, filed Oct. 2, 2006, the priority of which is hereby claimed under 35 U.S.C. §120 and which is the U.S. National Stage of PCT International Application No. PCT/DE2005/000570, filed Mar. 30, 2005, which designated the United States and has been published but not in English as International Publication No. WO 2005/094625 and which claims the priority of German Patent Application, Serial No. 10 2004 015 873.8, filed Mar. 31, 2004, pursuant to 35 U.S.C. 119(a)-(d).

The content of U.S. application Ser. No. 10/599,566 is incorporated herein by reference in its entirety as if fully set forth herein.

BACKGROUND OF THE INVENTION

The invention relates to an universally applicable detachable magnet holder which is suited for closing and opening of containers or capable of holding and detaching of an object.

Detachable magnet holders using the magnetic holding power of permanent magnets are known from prior art. If the magnets are arranged so that, in the closed state, the magnet poles having different polarities are opposite to each other, and, in the open state, the magnet poles having the same polarity are opposite to each, it is possible to obtain an especially effective closed state and self-acting opening and releasing, respectively. This prior art is described for example in the documents DD 97706, BE 669664, DE 2323058, DE 29622577 and DE 8902181.

Such kinds of magnet holders or closing devices have been used in practice in special cases only, as common magnets had a relatively big size and a great weight. At present, high-duty magnets generating remarkably stronger holding power are available, so that magnet holders or closing devices smaller in size and lower in weight can be produced. At the same time, new fields of application open up. However, up to now, the occurrence of magnetic shear forces has not been discussed or constructively considered. Magnetic shear forces are to be considered as forces which are generated when the magnet poles having different polarities are opposite to and mutually repel each other and dislocate the magnets to each other laterally.

Another problem arising with high-duty magnets is the great holding power thereof, which, on the one hand, is wanted, but on the other hand, renders an easy separating of magnets more difficult.

SUMMARY OF THE INVENTION

Therefore, object of this invention is to provide a detachable magnet holder, which can be opened easily and, at the same time, can be made in a miniaturized design, in spite of the fact that strong magnetic forces will act onto it.

This object is attained by a magnet holder which comprises a fixedly arranged magnet and an opposing magnet which is rotatable about a point of rotation. Each of the magnets has a magnet pole surface comprising at least two poles. In the closed state, the corresponding poles having different polarities are opposite to and attract each other. In the open state, after rotating the rotatable magnet by means of an actuation device, the poles having the same polarity are opposite to and mutually repel each other.

A distance element made of a non-ferromagnetic material is fixed to one of the magnet pole surfaces and has a bearing surface sized on the opposite magnet pole surface to be ⅓ of this surface, as a maximum. This distance element has a dual function. Due to the small bearing surface, the friction force during opening is smaller than when both these surfaces are in full contact with each other. In addition, the distance element prevents the magnet surfaces from contacting each other directly, so that a more even course of force is realized during opening procedure. The thickness of the distance element is selected based on the holding power and course of force wanted for the opening procedure.

Furthermore, a centering engaging device is arranged in the vicinity of the magnet poles. This centering engaging device comprises complementary engagement elements which interlock in the course of closing, wherein the engagement is suitably formed to absorb the shear forces during opening procedure, until they are reduced to minimum value determined by the structure, as the distance between the magnets increases.

The combination of these features ensures the strong shear forces generated by high-duty magnets to be absorbed directly at the place of occurrence, so that a small-sized magnet holder low in weight can be made.

According to another feature of the invention, the distance element is concentrically arranged relative to the point of rotation. In this way, friction forces can be kept particularly small.

According to another feature of the invention, the distance element is also designed as a centering engaging device. The dual function of this structural element allows the shear forces to be received directly at the place of occurrence so that a particularly small-sized design can be realized. At the same time, a hapticly favourable course of force is made possible during opening procedure.

According to another feature of the invention, the distance element and the centering engaging device are made of a strong plastic material having a low coefficient of friction.

BRIEF DESCRIPTION OF THE DRAWING

Below, the invention will be described by means of two exemplified embodiments.

DETAILED DESCRIPTION OF PREFERRED EMBODIMENTS

Figure 1A:
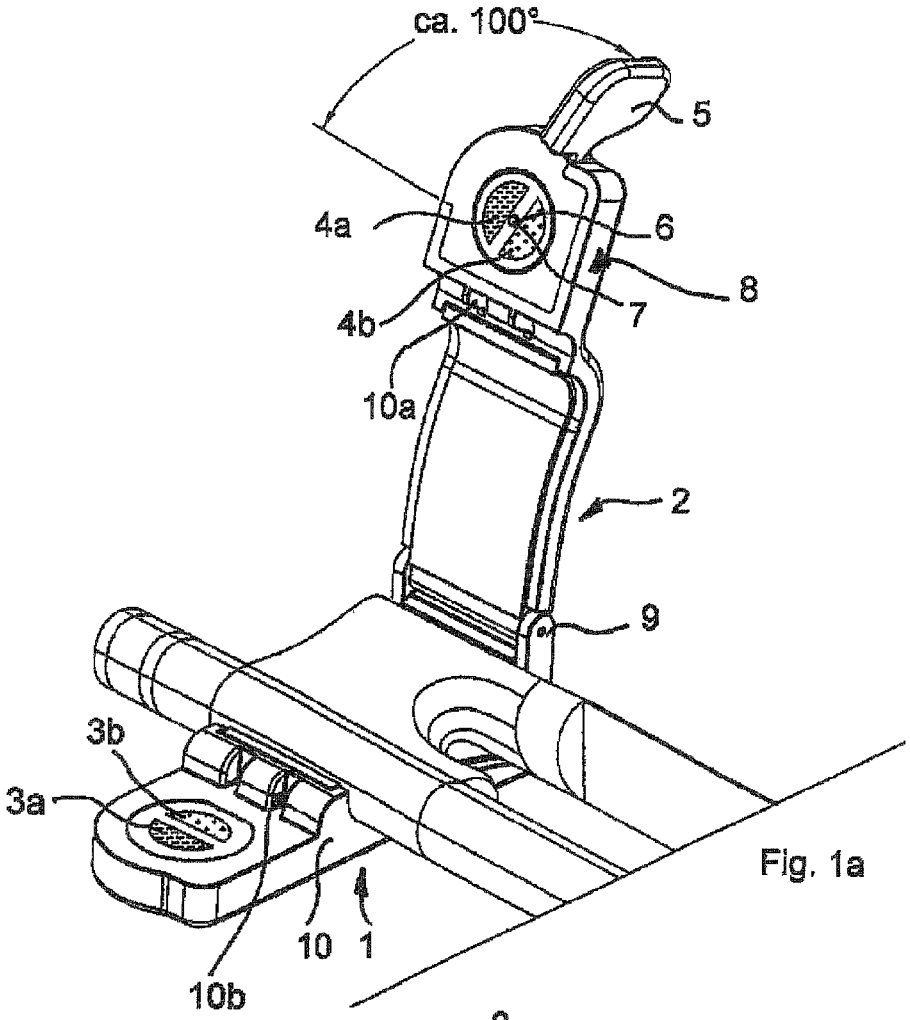
FIGS. 1*a* and 1*b* show a first embodiment of the invention.
Figure 1B:
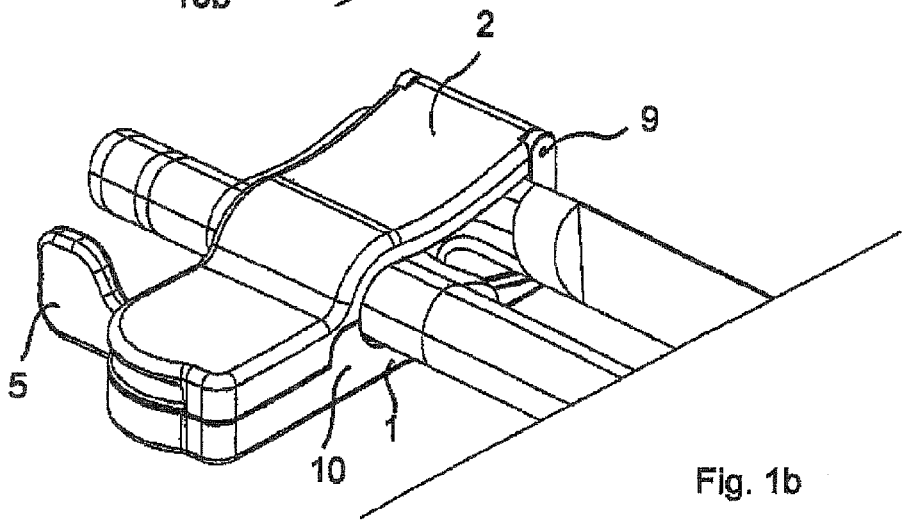

FIG. 1*a* shows an opened bow holding device for holding a stringed instrument bow. The magnet holder according to the invention, which is comprised of two pairs of magnets 3*a*, 3*b* and 4*a*, 4*b* respectively, is arranged on the bottom part 1 and on the pivoting upper part 2 of the bow holder, wherein the magnets 3*a*, 3*b* are fixed, whilst the magnets 4*a*, 4*b* can be rotated about a point of rotation 6 by an angle of about 100 degrees by operating a lever 5. The distance element is marked by a reference mark 7. The distance element 7, the axis of which is in line with point of rotation 6, prevents the magnet poles of different polarities from contacting each other, when they are opposite to and attract each other in the closed state. With this exemplified embodiment, the distance element 7 is a flat disk made of Teflon, which has a diameter D of 3 mm and a disk thickness T of 0.4 mm. An expert certainly knows in which way a rotatable magnet is held in case, so that no further explanation is necessary, but reference is given to FIG. 2 only, which shows the arrangement and support of the rotatable magnet within the case 8.

The magnets are dimensioned so that, with the closing procedure, the pair of rotatable magnets automatically rotates to the closed position, that is, by magnetic forces only, where the magnet poles having different polarities are opposite to each other. When the lever 5 is operated to rotate the pair of magnets 4*a*, 4*b*, the force keeping the bow holder closed is gradually reduced to zero and then changes into a gradually increasing repulsive force which opens the bow holder.

During the opening and closing procedure, shear forces also are generated, which cause the opposite-laying magnets to displace to each other laterally. This phenomenon can clearly be observed when trying to manually lay two magnets having the same polarity on each other. The shear forces apply a torque to the joint 9 via the top and the bottom part of the bow holder, which increases with the length thereof, that is, with length of the lever arm. This torque must be received by the joint. In order to prevent this, the invention comprises a centering engaging device 10. With this exemplified embodiment, the centering engaging device 10 comprises projections 10*a* which, in a predetermined phase before the bow holder is completely closed, slide into recesses 10*b* and thereby, receive the shear forces approximately there where they are generated.

Figure 2:
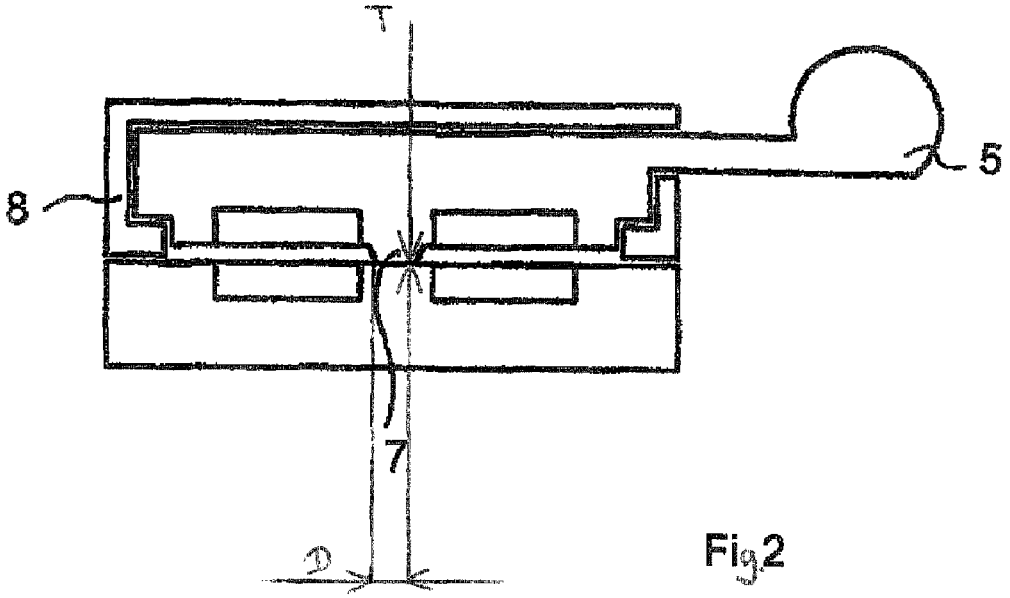
FIG. 2 shows the cross-section of a part of this embodiment.
Figure 3:
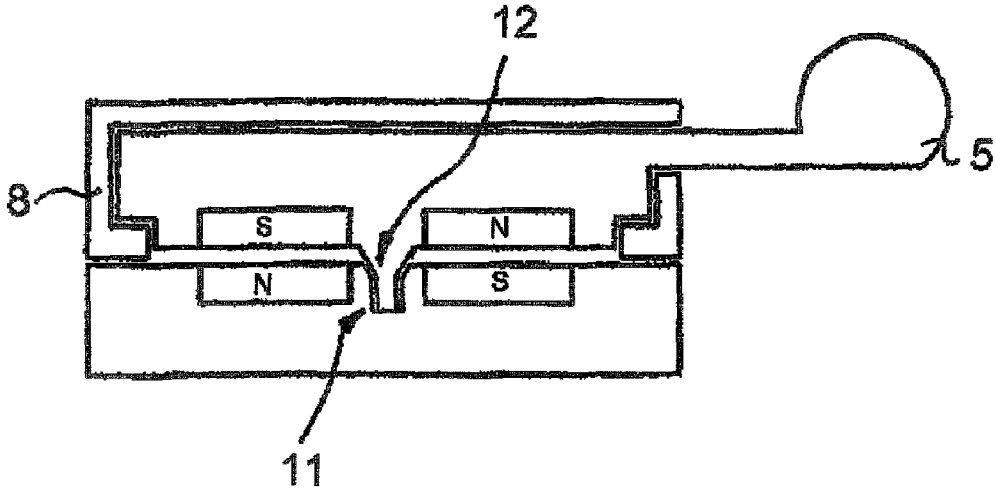
FIG. 3 shows a second embodiment of the invention.

The arrangement shown in FIG. 3 is the same as that in FIG. 2, with the exception that the distance element and the engaging element have other configurations. The distance element 7 and the centering engaging device 10 have been optimally united into a cylindrical plug connection 11 having a centering cone 12, which accomplishes the dual function mentioned above and receives the shear forces symmetrically with respect to rotation.

The structure and the magnet power are dimensioned so that, when the magnet holder is opened, the centering engaging device 10 remains engaged until the shear forces have reduced to a predetermined value.

In summary, it must be stated that the structure shown in FIG. 3 is the best embodiment of the technical theory.

An expert in this field certainly knows that, based on the disclosed theory, the configuration of the magnet poles, the distance device and the centering engaging device can be altered in numerous ways. Therefore, it is possible to provide a magnet holder for several applications, e.g. for closing and opening of a vacuum jug, a powder-box with a mirror or a spectacle-case, which does not wear and the haptic properties thereof can be realized easily and exactly.

What is claimed is:

1. A magnet holder, comprising:

a fixed first pair of magnets having a magnet pole surface defined by two poles;

a second pair of magnets having a magnet pole surface defined by two poles, the second pair of magnets being rotatable about a pivot for movement between an open position in which the poles of the first and second pairs of magnets are positioned to repel one another, and a closed state in which the poles of the first and second pairs of magnets are positioned to attract one another;

an actuation device for rotating the second pair of magnets to assume the open position;

a distance element made of a non-ferromagnetic material and arranged on one of the magnet pole surfaces of the first and second pairs of magnets, the distance element being constituted to prevent directly confronting magnet pole surfaces of the first and second pairs of magnets from contacting each other, the distance element being a cylindrical protection which is located between the two poles on the magnet pole surface of the associated pair of magnets and extends from the magnet pole surface of the associated pair of magnets in a direction toward the magnet pole surface of the other pair of magnets; and a centering engaging device for absorbing magnetic shear forces in vicinity of the magnet pole surfaces of the first and second pairs of magnets.

2. The magnet holder of claim 1, wherein the distance element is arranged in concentric relationship to the pivot.

3. The magnet holder of claim 1, wherein the distance element and the centering engaging device form a unitary structure.

4. The magnet holder of claim 1, wherein the distance element and the centering engaging device are made of a firm plastic material having a low coefficient of friction.

5. The magnet holder of claim 1, wherein the distance element is constructed in the form of a flat cylinder made of Teflon.

6. The magnet holder of claim 5, wherein the distance element is a disk having a diameter of 3 mm and a disk thickness of 0.4 mm.

7. The magnet holder of claim 1, further comprising a top part for accommodating one of the first and second pairs of magnets, and a bottom part for accommodating the other one of the first and second pairs of magnets, the centering engaging device including engagement elements formed on one of the top and bottom parts for engagement in recesses on the other one of the top and bottom parts.

8. The magnet holder of claim 7, wherein the engagement elements are constructed in the form of projections extending from the one of the top and bottom parts in a direction toward the other one of the top and bottom parts.

9. The magnet holder of claim 3, wherein the unitary structure is a cylindrical plug connection having a centering cone for engagement in a recess of the other one of the magnet pole surfaces of the first and second pairs of magnets.

10. The magnet holder of claim 1, wherein the actuating device is a lever operatively connected to the second pair of magnets.

* * * * *